United States Patent [19]

Takano et al.

[11] Patent Number: 4,920,245

[45] Date of Patent: Apr. 24, 1990

[54] A PUSH-BUTTON SWITCH WITH UNIFORM ON AND OFF TIMINGS

[75] Inventors: Yasunari Takano; Mitsuhiro Okada, both of Iwaki, Japan

[73] Assignee: Alps Electric Co., Ltd., Tokyo, Japan

[21] Appl. No.: 213,374

[22] Filed: Jun. 30, 1988

[30] Foreign Application Priority Data

Oct. 22, 1987 [JP] Japan ..... 62-160750[U]

[51] Int. Cl.[5] ..... H01N 3/42

[52] U.S. Cl. ..... 200/533; 200/521; 200/342

[58] Field of Search ..... 200/342, 341, 521, 533, 200/535, 542, 545

[56] References Cited

U.S. PATENT DOCUMENTS 4,479,040 10/1984 Denley et al. ..... 200/342
4,529,849 7/1985 Kamei et al. ..... 200/535
4,613,737 9/1986 Nishijima ..... 200/342

*Primary Examiner*—Renee S. Luebke

*Attorney, Agent, or Firm*—Guy W. Shoup; Paul J. Winters

[57] ABSTRACT

A push-button switch which eliminates a dispersion in on and off timings thereof is disclosed. The push-button switch has a pressing spring, and a switch element which includes a pressing piece, a fixed contact element and a movable contact element. The movable contact element is contacted with the fixed contact element when an acting projection of the pressing spring press against a movable contact element pressing portion at an end of a leg portion of the pressing piece. The movable contact element pressing portion of the pressing piece gradually narrows towards its end, and is of substantially the same thickness of material as the leg portion thereof. The gradually narrowing movable contact element pressing portion of the pressing piece is in a contiguous relationship to the leg portion has a projection provided on a surface thereof for contacting with the acting projection of the pressing spring and has a rib provided on the opposite face thereof for pressing against the movable contact element.

1 Claim, 5 Drawing Sheets

A PUSH-BUTTON SWITCH WITH UNIFORM ON AND OFF TIMINGS

BACKGROUND OF THE INVENTION

1. Field of the Invention

This invention relates to a push-button switch for use with various input devices, such as a personal computer or a word processor, and more particularly to improvements in or relating to that part of such a switch, the pressing piece, which presses against a movable contact element in the switch element of such a push button switch.

2. Description of the Prior Art

An example of a conventional push-button switch is illustrated in FIGS. 5 to 10. Referring to FIGS. 5 and 6, the conventional push-button switch shown includes a lower case 1 and an upper case 2 which are united with each other by a snap engaging mechanism (not shown) to form a unitary hollow casing. A fitting hole 2*a* is formed at a substantially central location on the upper wall of the upper case 2, and a stem 3 extends through the fitting hole 2*a*. A compression coil spring 5 is interposed between the stem 3 and an inner face of a bottom wall of the lower case 1, and a key top 4 is fitted on and secured to the top end of the stem 3. A switch element 6 is disposed at a side location within the casing formed by the lower case 1 and the upper case 2. The switch element 6 is supported on the upper case 2 in such a manner that it is prevented from moving toward the stem 3 by a pair of opposing ribs 2*b* formed on the opposite inner faces of a pair of side walls of the upper case 2. A pressing spring 11 is fitted at the top end of the switch element 6. The pressing spring 11 has a bent portion 11*a*, an extension 11*b*, and a semispherical acting projection 11*c*. The extension 11*b* of the compression spring 11 extends below the stem 3 and is bifurcated at its lower end. The extension 11*b* is located such that its bifurcated portion may move into and out of the locus of reciprocal motion of the stem 3. A leaf spring 12 is disposed on an inner face of a side wall of the upper case 2 in an opposing relationship to the switch element 6 with respect to the stem 3. The leaf spring 12 has an upright portion 12*a* extending along the inner face of the side wall of the upper case 2, and an extension 12*b* extending below the stem 3. A lower end portion of the extension 12*b* of the leaf spring 12 is resiliently engaged with the lower end of the stem 3, and the engaging lower end portion of the extension 12*b* has the form of a click projection 12*c* which can be moved into and out of the locus of reciprocal movement of the stem 3 at an intermediate location of its reciprocal movement. The upright portion 12*a* of the leaf spring 12 is held between the side wall of the upper case 2 and a base portion holding plate 13. The base portion holding plate 13 is supported on the upper case 2 in such a manner that it is prevented from moving toward the stem 3 by a pair of opposing ribs 2*c* formed on the inner faces of the side walls of the upper case 2.

Referring particularly to FIG. 7, the switch element 6 includes an operating body 7 made of a synthetic resin material, a movable contact element 8 made of a metal material, a spacer 9 made of a synthetic resin material, and a fixed contact element 10 made of a metal plate. The operating body 7 has a pressing piece 7*a*. The pressing plate 7*a* is comprised of a leg portion 20, and a movable contact element pressing portion 21. The movable contact element pressing portion 21 of the pressing piece 7*a* has a greater thickness of material than the leg portion 20 of the pressing piece 7*a*. As shown in FIGS. 9(*a*) and 9(*b*), a rib 22 is formed on one face of the movable contact element pressing portion 21. Adjacent to the operating body 7 is a movable contact element 8. The movable contact element 8 is composed of a frame 8*a* made of brass, and a resilient thin metal plate 8*b* made of phosphor bronze or a like material and supported on the frame 8*a*. Though not shown, gold is plated on one face of the thin metal plate 8*b*. Adjacent to the movable contact element 8 is a spacer 9. A circular opening 9*a* is perforated in the spacer 9. Adjacent to the spacer 9 is a fixed contact element 10 made of brass. On the fixed contact element 10 is a gold fixed contact element 10*a*. The gold fixed contact element 10*a* is opposed via the opening 9*a* in the spacer 9 to the thin metal plate 8*b* of the movable contact element 8. Pairs of engaging holes 8*c*, 9*b* and 10*b* are formed in a mutually aligned relationship at peripheral portions of the movable contact element 8, spacer 9 and fixed contact element 10, respectively. A pair of engaging projections not shown are formed on a rear face of the operating body 7 of the switch element 6 and extend through the engaging holes 8*c*, 9*b* and 10*b*. The ends of the engaging projections are caulked so that the components of the switch element 6, that is, the operating body 7, movable contact element 8, spacer 9 and fixed contact element 10, are united with each other in a layered condition. Note that the movable contact element 8 has a movable side terminal 8*d* formed thereon while the fixed contact element 10 has a fixed side terminal 10*c* formed thereon.

The push-button switch described above operates as follows.

When the key top 4 remains in a non-depressed state, as seen in FIG. 5, the stem 3 is positioned at its upper position under the biasing forces of the compression coil spring 5, the pressing spring 11, and the leaf spring 12. In this configuration, the acting projection 11*c* of the pressing spring 11 does not press against the movable contact element pressing portion 21 of the pressing piece 7*a* of the operating body 7 of the switch element 6. As a result, the thin metal plate 8*b* of the movable contact element 8 remains spaced away from the fixed contact 10*a* of the fixed contact element 10. Accordingly, the push-button switch assumes an off position.

If the key top 4 is depressed, the stem 3 is moved down against the spring 5, and in the course of such downward movement of the stem 3, the click projection 12*c* of the leaf spring 12 is retracted from the locus of movement of the stem 3. Consequently, a click feeling is provided. Further, since the pressing spring 11 is retracted from, the locus of movement of the stem 3 upon such downward movement of the stem 3, the movable contact element pressing portion 21 of the pressing piece 7*a* of the operating body 7 is pressed against the thin metal plate 8*b* of the movable contact element 8 by the acting projection 11*c* of the pressing spring 11 so that the thin metal plate 8*b* of the movable contact element 8 is displaced into contact with the fixed contact 10*a* of the fixed contact element 10, thereby bringing the push-button switch into an on state.

If the depressing force to the key top 4 is removed, then the stem 3 is moved upwardly back to its upper position of FIG. 5. Upon such upward movement of the stem 3, the pressing force to the movable contact element pressing portion 21 of the pressing piece 7*a* of the operating body 7 by the acting projection 11*c* of the pressing spring 11 is removed. Consequently, the thin metal plate 8*b* of the movable contact element 8 is spaced away from the fixed contact 10*a* of the fixed contact element 10, thereby bringing the push-button switch into an off state again.

There is a problem with the switch element 6 having the construction described above. After molding, a sink 23 will appear on the movable contact element pressing portion 21 where it contacts the acting projection 11*c* of the pressing spring 11. Referring to FIG. 9(*a*), the sink 23 appears because of the thickness $t_2$ of material of the movable contact element pressing portion 21 of the pressing piece 7*a*. Because the thickness $t_2$ is so great, and because the outer surfaces of the pressing piece 7*a* are cooled by exposure to the outside atmosphere during molding, the resin at the outer surfaces of the movable contact element pressing portion 21 of the pressing piece 7*a*, especially at the large surface where the movable contact element pressing portion 21 is contacted by the acting projection 11*c* of the pressing spring 11, cools and solidifies during molding before the resin at the inner portions of the movable contact element pressing portion 21 solidifies. This solidification upsets the flow of resin material flowing in from the leg portion 20 during molding. Resin continues to move up the leg portion 20 to the upper extremities of the pressing piece 7*a*, but the resistance created by the solidification of the outer surfaces results in less resin entering the movable contact element pressing portion 21 of the pressing piece 7*a* than desired, and this produces the sink 23.

If there is a sink 23 on the movable contact element pressing portion 21 of the pressing piece 7*a* where it is contacted by the acting projection 11*c* of the pressing spring 11, a dispersion may appear in timings at which the rib 22 on the opposite face of the movable contact element pressing portion 21 of the pressing piece 7*a* of the operating body 7 presses against the movable contact element 8. The sink 23 causes the dispersion. The dispersion occurs because the acting projection 11*c* may contact a different part of the sink 23 on the movable contact element pressing portion 21 of the pressing piece 7*a* on one switch operation than on the next switch operation. For example, if the acting projection 11*c* hits a lower part of the sink 23 on one operation than on the next, the switch will turn on later in the first operation than in the second.

SUMMARY OF THE INVENTION

The object of the present invention is to provide a push-button switch without dispersions in its on and off timings.

In order to attain the object, the present invention, provides a push-button switch having a casing, a stem mounted for manual depression in the casing, a pressing spring which operates upon movement of the stem, and a switch element disposed in the casing. When the stem is depressed, an acting projection of the pressing spring presses against a movable contact element pressing portion at an end of a leg portion of a pressing piece of the switch element, which in turn causes a movable contact element of the switch element to contact a fixed contact element, turning the switch on. When the depressing force is removed, the push-button switch is returned to its non-depressed original state. The push-button switch is constituted such that the movable contact element pressing portion of the pressing piece gradually narrows towards its end. This gradually narrowing movable contact element pressing portion of the pressing piece is substantially formed from the same thickness of material as the leg portion of the pressing piece, but it is obliquely offset to the leg portion 20 of the pressing piece 7*a*. The gradually narrowing movable contact pressing element portion of the pressing piece has a projection provided on a surface thereof for contacting with the acting projection of the pressing spring, and has a rib provided on the opposite face thereof for pressing against the movable contact element.

In the push-button switch of the present invention, the projection provided on the movable contact element pressing portion of the pressing piece of the switch element for contacting with the acting projection of the pressing spring can be formed to have a flat surface. Accordingly, at whichever location the surface of the projection provided on the movable contact element pressing portion is pushed by the acting projection of the pressing spring, there is no or little dispersion in timings at which the rib on the opposite face of the pressing portion presses against the movable contact element. Accordingly, there is no or little dispersion in timings at which the push-button switch is turned on or off.

The above and other objects, features and advantages of the present invention will become apparent from the following description and the appended claims, taken in conjunction with the accompanying drawings.

DETAILED DESCRIPTION OF THE PREFERRED EMBODIMENT

Figure 1:
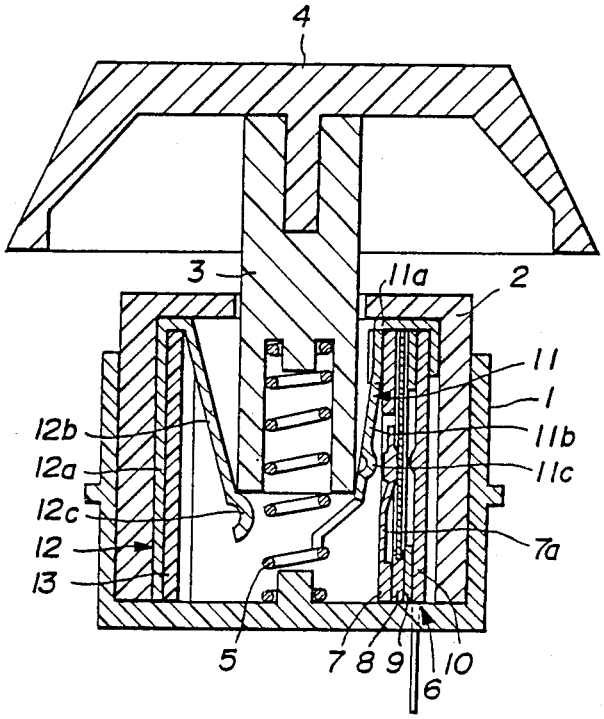
FIG. 1 is a vertical sectional view of a push-button switch showing a preferred embodiment of the present invention.
Figure 2:
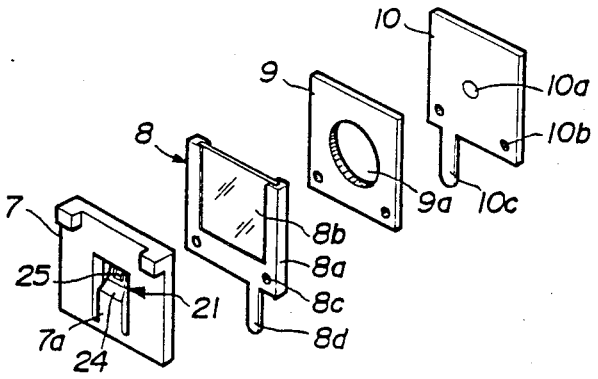
FIG. 2 is a fragmentary perspective view of a switch element of the push-button switch of FIG. 1.
Figure 3:
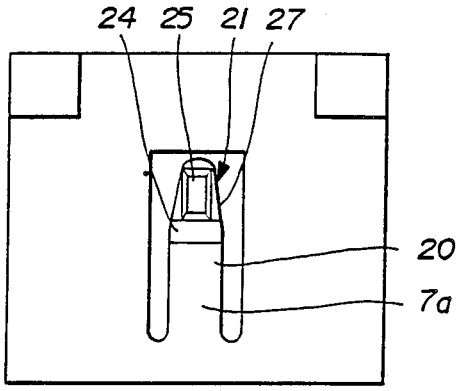
FIG. 3 is a plan view of an operating body of the switch element of FIG. 2.

Referring to FIGS. 1 to 4, there is shown a push-button switch incorporating the present invention. The push-button switch shown has a generally similar construction to that of the conventional push-button switch shown in FIGS. 5 to 10. Accordingly, like parts or elements are denoted by like reference numerals to those of FIGS. 5 to 10, and overlapping description thereof will be omitted herein to avoid redundancy.

The push-button switch of the present invention is different from the conventional push-button switch principally in structure of a pressing piece 7*a* formed on an operating body 7 of a switch element 6. Therefore, description will be given in detail below principally of the difference.

A movable contact pressing portion 21 at an end of the pressing piece 7*a* of the operating body 7 has a gradually narrowing portion 27 formed thereon. The gradually narrowing portion 27 has a thickness $t_3$ of material equal to the thickness $t_3$ of material of a leg portion 20 of the pressing portion 21 of the operating body 7. The gradually narrowing portion 27 is in a contiguous relationship to the leg portion 20 but is offset to it by an oblique offset portion 24. A projection 25 is provided on a face of the pressing portion 21 at which the pressing portion 21 is to contact with an acting projection 11*c* of a pressing spring 11, while a rib 26 for pressing against a movable contact element 8 is provided on the opposite face of the movable contact element pressing portion 21.

The push-button switch of the present invention operates as follows. If the key top 4 is depressed, a stem 3 is moved down while compressing a compression coil spring 5. Thereupon, an extension 11*b* of the pressing spring 11 is yieldably bent toward the switch element 6 so that the acting projection 11*c* thereon presses against the projection 25 of the movable contact element pressing portion 21 of the pressing piece 7*a* of the operating body 7. Consequently, the rib 26 on the movable contact element pressing portion 21 presses against the movable contact element 8 to contact the latter with fixed contact element 10, thereby turning the push-button switch on. Then, if the depressing force to the key top 4 is removed, the stem 3 is returned upward to its upper position as seen in FIG. 1. Upon such returning movement of the stem 3, the pressing force of the acting projection 11*c* of the pressing spring 11 against the movable contact element pressing portion 21 of the pressing piece 7*a* of the operating body 7 is removed so that the movable contact 8 is moved out of contact with the fixed contact element 10, whereupon the push-button switch is brought into an off state again.

Figure 4:
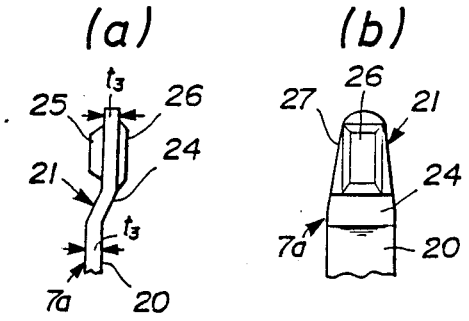
FIGS. 4(*a*) and 4(*b*) are a side elevational view and a plan view, respectively, of a pressing piece of the switch element of FIG. 2.
Figure 5:
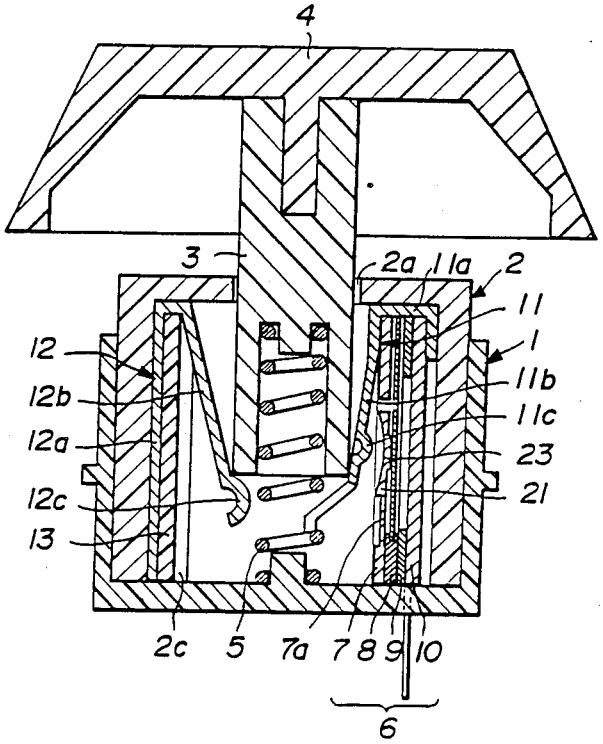
FIG. 5 PRIOR ART
FIG. 5 is a vertical sectional view of a conventional push-button switch.
Figure 6:
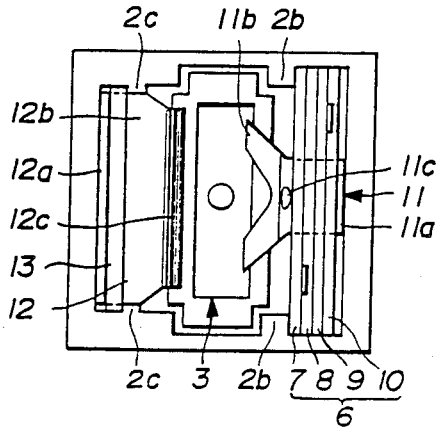
FIG. 6 PRIOR ART
FIG. 6 is a bottom plan view of the conventional push-button switch of FIG. 5 showing an upper case with a lower case removed.
Figure 7:
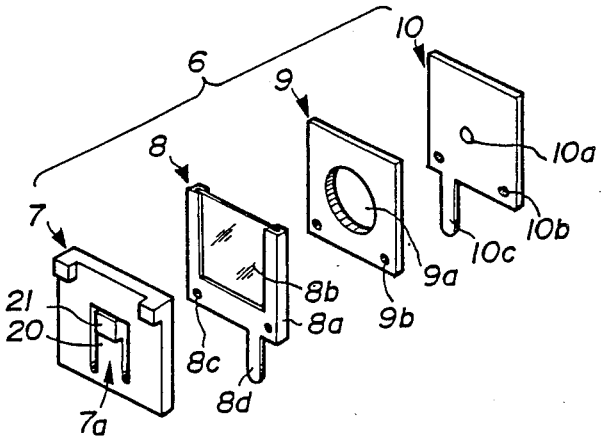
FIG. 7 PRIOR ART
FIG. 7 is a fragmentary perspective view of a switch element of the conventional push-button switch of FIG. 5.
Figure 8:
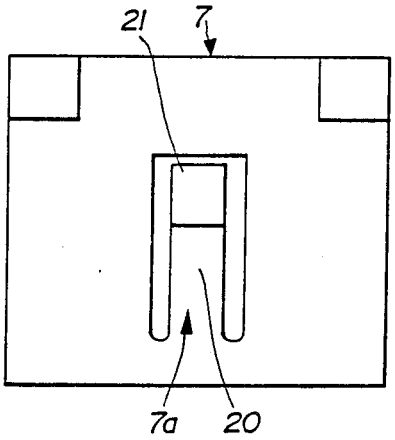
FIG. 8 PRIOR ART
FIG. 8 is a plan view of an operating body of the conventional push-button switch of FIG. 5.
Figure 9:
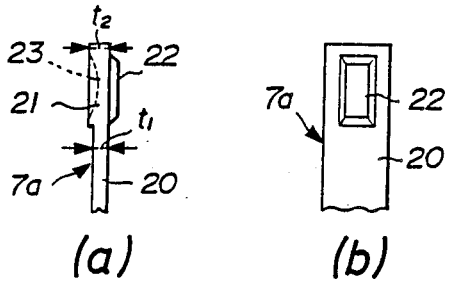
FIG. 9 PRIOR ART
FIGS. 9(*a*) and 9(*b*) are a side elevational view and a plan view, respectively, of a pressing piece of the conventional push-button switch of FIG. 5.
Figure 10:
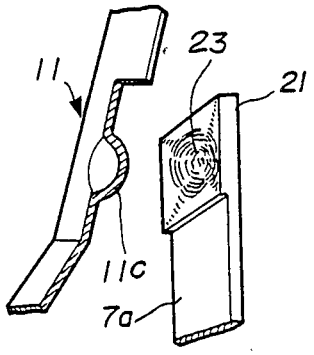
FIG. 10 PRIOR ART
FIG. 10 is a partial fragmentary perspective view showing a pressing spring of the push-button switch of FIG. 5 when an acting projection thereof presses against a movable contact element pressing portion of the operating body of FIG. 8.

The push-button switch of the present invention has little or no dispersion in its on and off timings because the projection 25 on the movable contact element pressing portion 21 is formed to have a flattened surface where it is contacted by the acting projection 11*c* of the pressing spring 11. Referring to FIGS. 4(*a*) and 4(*b*), the flat surface forms because the movable contact element pressing portion 21 of the pressing piece 7*a* gradually narrows, and is formed with the same thickness T3 of material as the leg portion 20 thereof, and because there are more corners on the movable contact element pressing portion 21 of the pressing piece 7*a*. The gradual narrowing, decreased thickness, and greater number of corners assures more uniform cooling and solidification of the pressing piece 7*a* during molding. Accordingly resin material flowing in from the leg portion 20 of the pressing piece 7*a* upon molding of the operating body 7 will pass the offset portion 24 and flow smoothly and without resistance into the gradually narrowing portion 27 at the end of the offset portion 24. If a sink does form, it will be small because, as seen in FIG. 4(*a*), the surface of the projection 25 is small in area. The offset 24 in the pressing piece 7*a* allowed more corners to be designed into the movable contact element pressing portion 21 of the pressing piece 7*a*, yet leaves the resulting structure with sufficient depth to span the gap between the acting projection 11*c* of the pressing spring 11 and the movable contact element 8, thus ensuring operation of the switch.

Because the surface of the projection 25 is flat, the on and off timings of the push-button switch are not affected by the particular location on the surface of the projection 25 that is pushed by the acting projection 11*c* during any given depression of the key top 4. Accordingly, there is no or little dispersion in timings at which the push-button switch is turned on or off.

Having now fully described the invention, it will be apparent to one of ordinary skill in the art that many changes and modifications can be made thereto without departing from the spirit and scope of the invention as set forth herein.

What is claimed is:

1. In a push-button switch having a casing, a pressing spring which operates upon movement of said stem, and a switch element disposed in said casing, said switch element operating so that when said stem is depressed, an acting projection of said pressing spring presses against a movable contact element pressing portion at an end of a leg portion of a pressing piece of said switch element causing a movable contact element of said switch element to contact a fixed contact element, and when the depressing force is removed, said push-button switch is returned to its non-depressed original state, the improvement comprising a movable contact element pressing portion of said pressing piece that gradually narrows, wherein said movable contact element pressing portion is of substantially the same thickness of material as said leg portion of said pressing piece, and said movable contact element pressing portion of said pressing piece is offset from said leg portion of said pressing piece, and said movable contact element pressing portion of said pressing piece has a projection provided on a surface thereof for contacting with said acting projection of said pressing spring, and said movable contact element pressing portion of said pressing piece has a rib provided on the opposite face thereof for pressing against said movable contact element.

* * * * *

UNITED STATES PATENT AND TRADEMARK OFFICE

CERTIFICATE OF CORRECTION

PATENT NO. : 4,920,245

DATED : April 24, 1990

INVENTOR(S) : Yasunari Takano et al.

It is certified that error appears in the above-identified patent and that said Letters Patent is hereby corrected as shown below:

On the title page, item [57],
Abstract:

Line 7 - "press" should be --presses--

Line 15 - after "portion" insert --of the pressing piece, but is offset to it. The movable contact element pressing portion of the pressing piece--

Claim 1 Col. 6,

Line 32 - after "casing," insert --a stem mounted for manual depression in said casing,--

Signed and Sealed this

Ninth Day of July, 1991

*Attest:*

HARRY F. MANBECK, JR.

*Attesting Officer*

*Commissioner of Patents and Trademarks*